US006008166A

United States Patent [19]

Cook et al.

[11] Patent Number: 6,008,166

[45] **Date of Patent: *Dec. 28, 1999**

[54] DETERGENT COMPOSITIONS

[75] Inventors: Stephen James Cook, North Humberside, United Kingdom; Sean Patrick O'Connor, Ridgefield, Conn.; John Crawford, Surrey, United Kingdom

[73] Assignee: Lubrizol Adibis Holdings Limited, Merseyside, United Kingdom

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/904,645

[22] Filed: Aug. 1, 1997

Related U.S. Application Data

[63] Continuation of application No. 08/371,552, Jan. 11, 1995, Pat. No. 5,674,821.

[30] Foreign Application Priority Data

Jan. 11, 1994 [GB] United Kingdom ..... 9400415

[51] Int. Cl.[6] ..... C10M 159/22

[52] U.S. Cl. ..... 508/452; 508/574; 508/586

[58] Field of Search ..... 508/452, 574, 508/586

[56] References Cited

U.S. PATENT DOCUMENTS

| | | | |
|---|---|---|---|
| 3,367,867 | 2/1968 | Abbot et al. | 252/42.7 |
| 3,372,116 | 3/1968 | Meinhardt . | |
| 3,951,830 | 4/1976 | Karn | 252/42.7 |
| 5,069,804 | 12/1991 | Marsh et al. | 252/42.7 |
| 5,244,588 | 9/1993 | Koshima et al. | 252/25 |
| 5,320,763 | 6/1994 | Campbell | 252/25 |
| 5,674,821 | 10/1997 | Cook et al. | 508/452 |
| 5,792,735 | 8/1998 | Cook et al. | 508/452 |

FOREIGN PATENT DOCUMENTS

| | | |
|---|---|---|
| 0 271 262 | 6/1988 | European Pat. Off. . |
| 0 273 588 | 7/1988 | European Pat. Off. . |

OTHER PUBLICATIONS

"Adibis Calcium Phenates" product brochure, date unknown.

EPO Search Report from Application No. 95300089.0, mailed Nov. 14, 1996.

*Primary Examiner*—Jerry D. Johnson

*Attorney, Agent, or Firm*—Michael F. Esposito; David M. Shold

[57] ABSTRACT

A detergent concentrate composition suitable for incorporation into a finished lubricating oil comprises:

(A) an additive concentrate comprising:

(a) a lubricating oil, and (b) a lubricating oil soluble sulphurised or non-sulphurised alkaline earth metal hydrocarbyl phenate modified by reaction to incorporate from greater than 2 to less than 40% by weight based on the weight of the concentrate (A) of either (i) at least one carboxylic acid having the formula:

(I)

wherein R is a $C_{10}$ to $C_{24}$ alkyl or alkenyl group and $R^1$ is either hydrogen, a $C_1$ to $C_4$ alkyl group or a —$CH_2$-COOH group, or an anhydride or ester thereof, or (ii) a di- or polycarboxylic acid containing from 36 to 100 carbon atoms or an anhydride or ester thereof, the concentrate having a BN greater than 300 and a viscosity at 100° C. of less than 1000 cSt, and (B) an additive concentrate comprising:

(a) a lubricating oil, and (b) a lubricating oil soluble sulphurised or non-sulphurised alkaline earth metal hydrocarbyl phenate, that has not been modified or has been modified by reaction to incorporate less than 0.1% by weight based on the weight of the concentrate (B) of either (i) or (ii), the concentrate preferably having a BN of less than 300.

10 Claims, 2 Drawing Sheets

DETERGENT COMPOSITIONS

This is a continuation of application Ser. No. 08/371,552, filed Jan. 11, 1995, now U.S. Pat. No. 5,674,821.

BACKGROUND OF THE INVENTION

The present invention relates in general to detergent compositions and in particular to alkaline earth metal hydrocarbyl phenate compositions.

In the internal combustion engine by-products from the combustion chamber often blow by the piston and admix with the lubricating oil. Many of these by-products form harmful acidic materials within the lubricating oil. Compounds, generally referred to as detergents, are employed to neutralise the acidic materials and disperse sludge within the lubricating oil and also help to keep engine pistons clean from deposits and lacquer. The alkaline earth metal hydrocarbyl phenates are one class of compound which have been used for this purpose. Both "normal" and "overbased" phenates have been employed. Alkaline earth metal hydrocarbyl phenates having BNs (Base Numbers as measured in mg KOH/g by the method of ASTM D2896) of less than about 300, typically 250 or less are well-known in the art. Recently, alkaline earth metal hydrocarbyl phenate compositions having BN's greater than 300, and modified by reaction with carboxylic acid have been made. Thus, our EP-A-271262, for example, discloses an additive concentrate suitable for incorporation into a finished lubricating oil composition, the additive concentrate comprising:

(a) a lubricating oil, (b) a lubricating oil soluble sulphurised or non-sulphurised alkaline earth metal hydrocarbyl phenate modified by incorporation of from greater than 2 to less than 40% by weight based on the weight of the concentrate of either (i) at least one carboxylic acid having the formula:

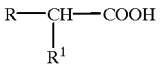

(I)

wherein R is a $C_{10}$ to $C_{24}$ alkyl or alkenyl group and $R^1$ is either hydrogen, a $C_1$ to $C_4$ alkyl group or a —$CH_2$-COOH group, or an anhydride, acid chloride or ester thereof or (ii) a di- or polycarboxylic acid containing from 36 to 100 carbon atoms or an anhydride, acid chloride or ester thereof, the concentrate having a BN greater than 300.

DESCRIPTION OF THE INVENTION

We have now unexpectedly found that the ability to provide piston cleanliness in internal combustion engines, of conventional phenates can be enhanced by admixing them with phenates which have been modified by reaction with carboxylic acids for example those of the general type disclosed in EP-A-271262.

Accordingly, the present invention provides a detergent concentrate composition suitable for incorporation into a finished lubricating oil comprising:

(A) an additive concentrate comprising:

(a) a lubricating oil, and (b) a lubricating oil soluble sulphurised or non-sulphurised alkaline earth metal hydrocarbyl phenate modified by reaction to incorporate from greater than 2 to less than 40% by weight based on the weight of the concentrate (A) of either (i) at least one carboxylic acid having the formula:

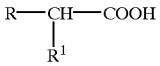

(I)

wherein R is a $C_{10}$ to $C_{24}$ alkyl or alkenyl group and $R^1$ is either hydrogen, a $C_1$ to $C_4$ alkyl group or a —$CH_2$-COOH group, or an anhydride or ester thereof, or (ii) a di- or polycarboxylic acid containing from 36 to 100 carbon atoms or an anhydride or ester thereof, the concentrate preferably having a BN greater than 300 and a viscosity at 100° C. of less than 1000 cSt, and (B) an additive concentrate comprising:

(a) a lubricating oil, and (b) a lubricating oil soluble sulphurised or non-sulphurised alkaline earth metal hydrocarbyl phenate, that has not been modified or has been modified by reaction to incorporate less than 0.1% by weight based on the weight of the concentrate (B) of either (i) or (ii), the concentrate preferably having a BN of less than 300.

Whilst the components (A) and (B) of the detergent concentrate composition may be present in any proportion they are suitably present in the proportions (A):(B) of about 90:10 to 20:80, preferably from about 70:30, to 20:80, more preferably from about 55:45 to 30:70, in terms of their relative percentage BN contributions to the total BN of the finished lubricating oil composition.

Turning now to the individual component (A) of the detergent concentrate, it is comprised of (a) a lubricating oil and (b) a lubricating oil soluble sulphurised or non-sulphurised alkaline earth metal hydrocarbyl phenate modified by reaction to incorporate from greater than 2 to less than 40% by weight based on the weight of the concentrate (A) of the acids (i) or (ii).

Component (a) of the component (A) is a lubricating oil. The lubricating oil may suitably be either an animal oil, a vegetable oil or a mineral oil. Suitably the lubricating oil may be a petroleum-derived lubricating oil, such as a naphthenic base, paraffin base or mixed base oil. Solvent neutral oils are particularly suitable. Alternatively, the lubricating oil may be a synthetic lubricating oil. Suitable synthetic lubricating oils include synthetic ester lubricating oils, which oils include diesters such as di-octyl adipate, di-octyl sebacate and tridecyladipate, or polymeric hydrocarbon lubricating oils, for example liquid polyisobutenes and poly-alpha olefins. The lubricating oil may suitably comprise from 10 to 90%, preferably from 10 to 70%, by weight of the composition.

Component (b) of component (A) is a lubricating oil soluble sulphurised or non-sulphurised, preferably sulphurised, alkaline earth metal hydrocarbyl phenate modified by incorporation of from greater than 2 to less than 40% by weight based on the weight of the concentrate (A) of either (i) or (ii). Suitably the alkaline earth metal may be strontium, calcium, magnesium or barium, preferably calcium, barium or magnesium, more preferably calcium. The hydrocarbyl phenate moiety of the alkaline earth metal hydrocarbyl phenate is preferably derived from at least one alkyl phenol. The alkyl groups of the alkyl phenol may be branched or unbranched. Suitable alkyl groups contain from 4 to 50, preferably from 9 to 28 carbon atoms. A particularly suitable alkyl phenol is the $C_{12}$-alkyl phenol obtained by alkylating phenol with propylene tetramer.

The alkaline earth metal hydrocarbyl phenate is modified by incorporation of either (i) or (ii). As regards (i), this is at least one carboxylic acid having the formula (I) or an acid anhydride or ester thereof. Preferably R in the formula (I) is an unbranched alkyl or alkenyl group. Preferred acids of formula (I) are those wherein R is a $C_{10}$ to $C_{24}$, more preferably $C_{18}$ to $C_{24}$ straight chain alkyl group and $R^1$ is hydrogen. Examples of suitable saturated carboxylic acids of formula (I) include capric acid, lauric acid, myristic acid, palmitic acid, stearic acid, arachidic acid, behenic acid and lignoceric acid. Examples of suitable unsaturated acids of formula (I) include lauroleic acid, myristoleic acid, palmitoleic acid, oleic acid, gadoleic acid, erucic acid, ricinoleic acid, linoleic acid and linolenic acid. Hixtures of acids may also be employed, for example rape top fatty acids. Particularly suitable mixtures of acids are those commercial grades containing a range of acids, including both saturated and unsaturated acids. Such mixtures may be obtained synthetically or may be derived from natural products, for example cotton oil, ground nut oil, coconut oil, linseed oil, palm kernel oil, olive oil, corn oil, palm oil, castor oil, soyabean oil, sunflower oil, herring oil, sardine oil and tallow. Sulphurised acids and acid mixtures may also be employed. Instead of, or in addition to, the carboxylic acid there may be used the acid anhydride or the ester derivatives of the acid, preferably the acid anhydride. It is preferred however to use a carboxylic acid or a mixture of carboxylic acids. A preferred carboxylic acid of formula (I) is stearic acid.

Instead of, or in addition to (i), the alkaline earth metal hydrocarbyl phenate may be modified by incorporation of (ii), which is a di- or polycarboxylic acid containing from 36 to 100 carbon atoms or an acid anhydride or ester derivative thereof, preferably an acid anhydride thereof. Preferably (ii) is a polyisobutene succinic acid or a polyisobutene succinic anhydride.

Preferably the carboxylic acid(s) having the formula (I), the di- or polycarboxylic acid, or the acid anhydride, acid chloride or ester thereof is incorporated in an amount from 5% (for example greater than 10%) to 35%, more preferably from 12 to 20%, for example about 16% by weight based on the weight of the concentrate. An advantage of incorporating greater than 10% of the carboxylic acid or derivative thereof is generally a relatively lower concentrate viscosity.

Preferably the BN of component (A) is greater than 300, more preferably greater than 350 for example greater than 400.

Suitably component (A) may have a viscosity measured at 100° C. of less than 750 cSt, more preferably less than 500 cSt.

Component (A) may suitably be obtained by the methods described, for example, in EP-A-271262 or EP-A-273588. Typically, component (A) may be produced by reacting at elevated temperature (1) either (i) a hydrocarbyl phenol, (ii) a hydrocarbyl phenol and sulphur or (iii) a sulphurised or non-sulphurised alkaline earth metal hydrocarbyl phenate, (2) an alkaline earth metal base added in either a single addition or in a plurality of additions at intermediate points during the reaction, (3) either a polyhydric alcohol having from 2 to 4 carbon atoms, a di- or tri- ($C_2$ to $C_4$) glycol, an alkylene glycol alkyl ether or a polyalkylene glycol alkyl ether, (4) a lubricating oil, (5) carbon dioxide added subsequent to the, or each, addition of component (2), (6) sufficient to provide from greater than 2 to less than 40% by weight based on the weight of the concentrate of either (i) a carboxylic acid having the formula (I) or an acid anhydride or ester thereof or (ii) a di- or polycarboxylic acid containing from 36 to 100 carbon atoms or an acid anhydride or ester thereof, and, optionally, (7) an overbasing catalyst, the weight ratio of components (1) to (6) being such as to produce a concentrate having a BN greater than 300 and a viscosity at 100° C. of less than 1000 cSt.

Modifications of the preparative method described hereinabove are to be found in, for example, EP-A-Nos. 354647; 385616; or 410648.

A suitable component (A) is currently marketed by BP Chemicals (Additives) Limited as ADX410 which is a concentrate having a BN of about 400 comprising a lubricating oil solution of a sulphurised calcium alkyl phenate modified by treatment with carboxylic acid.

Alternatively there may be used as the component (A) as hereinbefore described which is modified further by reaction with an aldehyde, for example formaldehyde. Such a concentrate may incorporate a greater proportion of lubricating oil at comparable TB's as described for example in our copending unpublished GB application number 9318810.0.

Component (B) is an additive concentrate comprising (a) a lubricating oil, and (b) a lubricating oil soluble sulphurised or non-sulphurised alkaline earth metal hydrocarbyl phenate, which has not been modified or has been modified by reaction to incorporate less than 0.1% by weight based on the weight of the concentrate (B) of either (i) or (ii), the concentrate preferably having a BN of up to 300. As the lubricating oil there may be used any of the lubricating oils described in relation to component (A)(a).

Preferably component (B)(a) is substantially identical to component (A)(a).

As regards component (B)(b) this may be any suitable lubricating oil soluble sulphurised or non-sulphurised alkaline earth metal hydrocarbyl phenate. Both neutral and overbased phenates may be employed. Generally, the phenates useful as component (B) will not contain the carboxylic acid having the formula (I) or the di- or polycarboxylic acid incorporated as (i) or (ii) in (b) of additive concentrate (A), although trace amounts up to 0.1% by weight may be present, perhaps by contamination. Suitably the alkaline earth metal may be strontium, calcium, magnesium or barium, preferably calcium, barium or magnesium, more preferably calcium. The hydrocarbyl moiety may suitably be a branched or unbranched alkyl group containing from 4 to 50, preferably from 9 to 28 carbon atoms, for example a $C_{12}$-alkyl group. Many such phenates are commercially available, for example ADX402 which is a lubricating oil concentrate having a BN of about 250 of a sulphurised calcium alkyl phenate marketed by BP Chemicals (Additives) Limited. Other suitable phenate concentrates for use, as component (B) have BN's in the range 270–240, alternatively 160–140 and 100–80.

A preferred detergent concentrate composition suitable for incorporation into a finished lubricating oil comprises:

(A) an additive concentrate having a BN of about 400 and a viscosity at 100° C. of less than 750 cSt comprising:

(a) a lubricating oil, and (b) a lubricating oil -soluble sulphurised calcium $C_{12}$-alkyl phenate modified by reaction to incorporate from greater than 10% to 20% by weight based on the weight of the concentrate (A) of stearic acid, and (B) an additive concentrate having a BN of about 250 comprising:

(a) a lubricating oil, and (b) a lubricating oil-soluble calcium $C_{12}$-alkyl phenate, in the proportion of (A):(B) such that their relative percentage BN contributions to the total BN of the finished lubricating oil is in the range from 55:45 to 30:70.

A particularly preferred detergent concentrate composition comprises a mixture of the aforesaid ADX 410 and ADX 402 in the proportion of ADX 410 to ADX 402 such that their relative percentage BN contribution to the total BN of the finished lubricating oil composition is in the range from 55:45 to 30:70, typically about 35:65.

As inferred hereinbefore the detergent concentrate composition may suitably be prepared by mixing the components.

In a final aspect the present invention provides a finished lubricating oil composition which composition comprises a lubricating oil and sufficient of the detergent concentrate composition as hereinbefore described to provide a BN in the range from 0.5 to 120.

Preferably the finished lubricating oil composition contains sufficient of the detergent concentrate composition to provide a BN in the range from 0.5 to 100.

The amount of detergent concentrate composition present in the finished lubricating oil will depend on the nature of the final use. Thus, for marine lubricating oils the amount of detergent concentrate composition present may suitably be sufficient to provide a BN in the range from 9 to 100 and for automobile engine lubricating oils the amount may suitably be sufficient to provide a BN in the range from 4 to 20.

The finished lubricating oil may also contain effective amounts of one or more other types of conventional lubricating oil additives, for example viscosity index improvers, anti-wear agents, antioxidants, dispersants, rust inhibitors, pour-point depressants, or the like.

BRIEF DESCRIPTION OF THE DRAWINGS

The invention will now be further illustrated by reference to the following drawings Examples.

In all the Examples the term "BN" is used. The BN is the Base Number in mg KOH/g as measured by the method of ASTM D2896.

The viscosity was measured by the method of ASTM D445.

In the Examples reference will be made to ADX 410 and ADX 402 which are materials described hereinbefore, ADX 410 having a BN of about 400 and ADX 402 having a BN of about 250.

EXAMPLES 1 to 4

ADX 410 and ADX 402 were mixed in proportions such that their percentage BN contributions to a finished lubricating oil of constant BN were:

| | | |
|---|---|---|
| Ex. 1 | 66.67% | ADX 410 |
| | 33.33% | ADX 402 |
| Ex. 2 | 50% | ADX 410 |
| | 50% | ADX 402 |
| Ex. 3 | 33.33% | ADX 410 |
| | 66.67% | ADX 402 |
| Ex. 4 | 25% | ADX 410 |
| | 75% | ADX 402 |

The mixtures were tested in identical formulations in a Fetter AVB (CEC) Test 'Cascade' on 1.2% ash, SAE 15W40, MB227.1, API CF4, CCMC D4 Diesel Oils.

COMPARISON TESTS 1 AND 2

ADX 410 and ADX 402 after appropriate formulation were tested individually in the Petter AVB test as used for Examples 1 to 4.

The results of Examples 1 to 4 and Comparison Tests 1 and 2 are presented in graphical form in the accompanying Figure. (ND COP is non-dispersant olefin copolymer).

It can be seen that the addition of ADX 410 to ADX 402 leads to Petter AVB (CEC) Total Ratings superior to those to be expected from summation of the values for the individual components.

EXAMPLE 5

The mixture of Example 3 (250:40OTBN of 2:1 BN) was tested in the Caterpillar 1 C2 test. The results are given in the accompanying Table.

COMPARISON TEST 3

Example 5 was repeated except that instead of using the mixture of Example 3 there was used ADX 402 alone. The results are given in the accompanying Table.

EXAMPLE 6

The mixture of Example 4 was tested in the Petter AVB (CEC) and the Caterpillar 1 G2 tests on 9BN 1.2% ash, SAE30 Multi-Purpose Diesel Oil.

Figure 1:
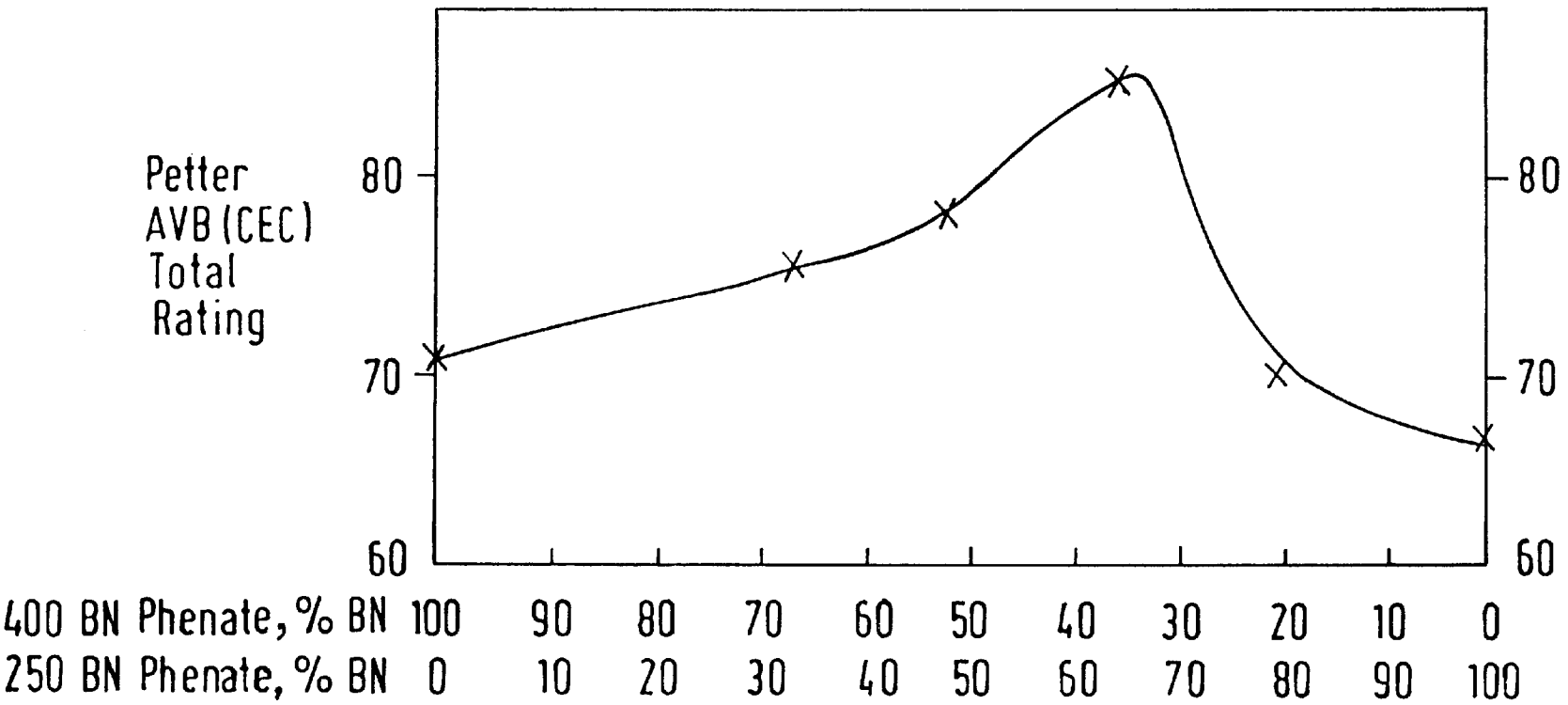
FIG. 1 illustrates Petter AVB Test results.
Figure 2:
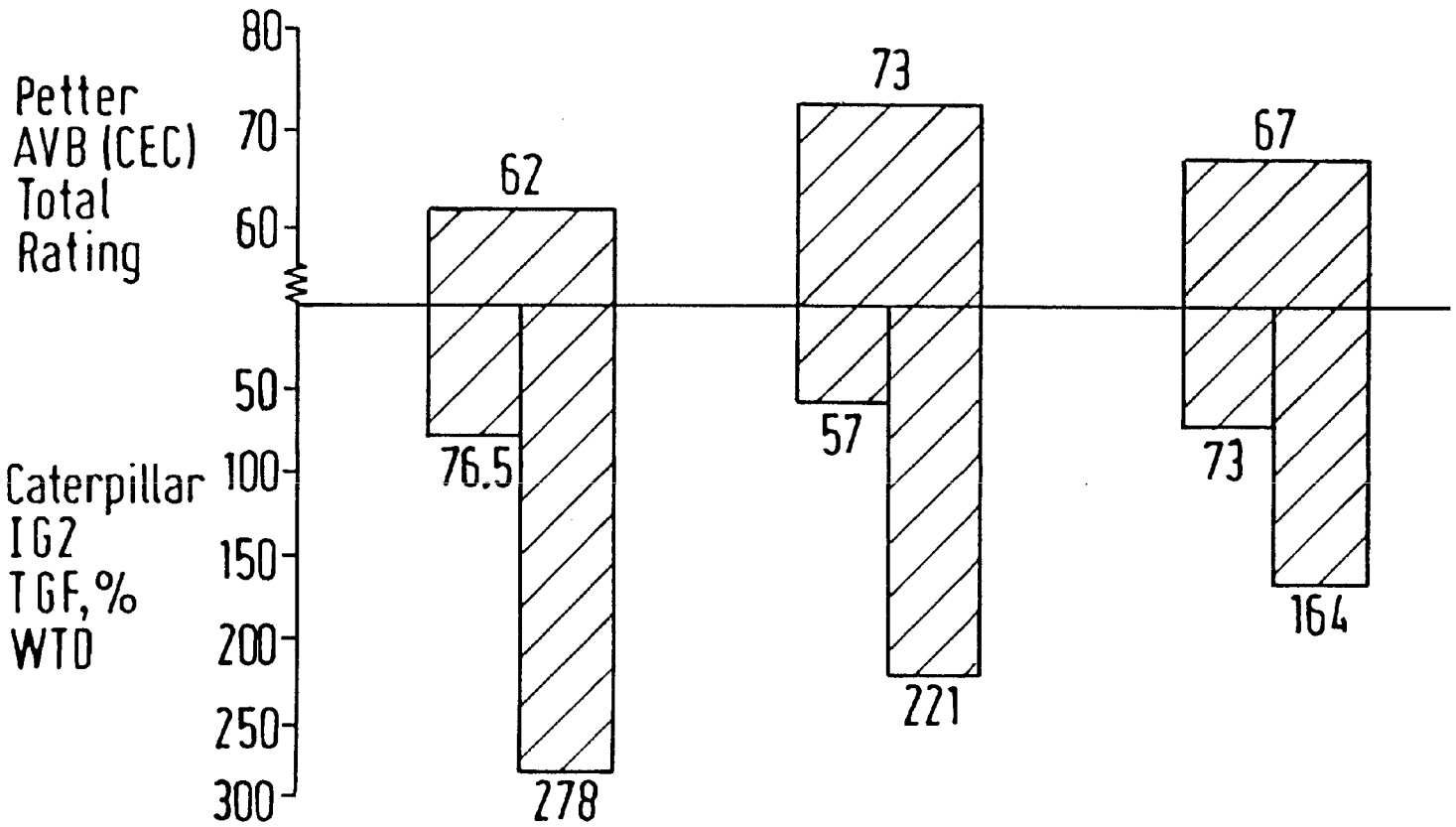
FIG. 2 illustrates Petter AVB and Caterpillar 1G2 Test results.

The results are given in FIG. 2.

EXAMPLE 7

Example 6 was repeated except that instead of using the mixture of Example 6 there was used a mixture of ADX 410 and a 150 BN lubricating oil concentrate of a calcium alkyl phenate at 3.8:1 BN.

The results are given in FIG. 2.

COMPARISON TEST 4

Example 6 was repeated except that there was used, instead of the mixture of Example 4, ADX 402 alone.

The results are given in FIG. 2.

AUTOMOTIVE DIESEL ENGINE OIL DATA

| | | Results | | |
|---|---|---|---|---|
| | | 250BN Phenate | | 250BN Phenate + 400BN Phenate |
| Oil | Test | 1 | 2 | (@ 2:1BN) |
| 1.2% ash, MB227.1 API CF4, CCMC D4, SAE 15W40 NDOCP | Caterpillar 1G2 | 66 | 57 | 68 |
| | TGF, % | 240 Hrs. | | |
| | WTD | 484 | 432 | 299 |
| 1.8% ash, MB228.3 API CE, CCMC D5, SAE 15W40 NDOCP | Caterpillar 1G2 | 73 | | 39 |
| | TGF, % | 240 Hrs. | | |
| | WTD | 457 | | 183 |

We claim:

1. A detergent concentrate composition suitable for incorporation into a finished lubricating oil comprising:

(A) an additive concentrate comprising:

(a) a lubricating oil, and (b) a lubricating oil soluble sulphurised or non-sulphurised alkaline earth metal hydrocarbyl phenate modified by reaction to incorporate from greater than 2 to less than 40% by weight based on the weight of the concentrate (A) of either (i) at least one carboxylic acid having the formula:

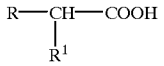

(I)

wherein R is a $C_{10}$ to $C_{24}$ alkyl or alkenyl group and $R^1$ is either hydrogen, a $C_1$ to $C_4$ alkyl group or a —$CH_2$-COOH group, or an anhydride or ester thereof, or (ii) a di- or polycarboxylic acid containing from 36 to 100 carbon atoms or an anhydride or ester thereof, the concentrate having a BN greater than 300 and a viscosity at 100° C. of less than 1000 cSt, and (B) an additive concentrate comprising:

(a) a lubricating oil, and (b) a lubricating oil soluble sulphurised or non-sulphurised alkaline earth metal hydrocarbyl phenate, that has not been modified or has been modified by reaction to incorporate less than 0.1% by weight based on the weight of the concentrate (B) of either (i) or (ii), the concentratve having a BN of less than 300.

2. A detergent concentrate composition as claimed in claim 1 wherein the phenate of component A(b) is modified by reaction to incorporate from greater than 10% to 20% by weight based on the weight of the concentrate (A) of (i).

3. A detergent concentrate composition as claimed in claim 1 wherein the hydrocarbyl phenate of A(b) is modified by reaction to incorporate stearic acid.

4. A detergent concentrate composition as claimed in claim 1 wherein the hydrocarbyl on component (A) phenate is further modified by reaction with an aldehyde.

5. A detergent concentrate composition as claimed in claim 1 wherein (A) is an additive concentrate having a BN greater than 400.

6. A detergent concentrate composition as claimed in claim 1 wherein component (B) has a BN in the range 240–270.

7. A detergent concentrate composition as claimed in claim I wherein (A) and (B) are present such that the relative percentage BN contributions of (A) and (B) to the total BN of the finished lubricating oil is in the range 55:45 to 30:70.

8. A finished lubricating oil composition comprising lubricating oil and sufficient of the detergent concentrate composition as claimed in claim 1 to give a BN in the lubricating oil composition in the range 0.5 to 100.

9. A detergent concentrate composition as claimed in claim 1, wherein additive concentrate (A) has a viscosity at 100° C. of less than 750 cSt.

10. A detergent concentrate composition according to claim 9, wherein said viscosity at 100° C. is less than 500 cSt.

* * * * *